US008943931B2

(12) United States Patent
Chiang

(10) Patent No.: US 8,943,931 B2
(45) Date of Patent: Feb. 3, 2015

(54) FASTENER HOLDER FOR POWER TOOL

(71) Applicant: Wen Hung Chiang, Taichung (TW)

(72) Inventor: Wen Hung Chiang, Taichung (TW)

( * ) Notice: Subject to any disclaimer, the term of this patent is extended or adjusted under 35 U.S.C. 154(b) by 219 days.

(21) Appl. No.: 13/717,825

(22) Filed: Dec. 18, 2012

(65) Prior Publication Data

US 2014/0165794 A1 Jun. 19, 2014

(51) Int. Cl.

| | |
|---|---|
| ***B25B 23/10*** | (2006.01) |
| ***B25B 23/12*** | (2006.01) |
| ***B25B 23/00*** | (2006.01) |
| *B25B 15/00* | (2006.01) |

(52) U.S. Cl.

CPC ..... *B25B 15/001* (2013.01); *B25B 23/0035* (2013.01); *B25B 23/12* (2013.01)

USPC ..... 81/429; 81/451; 81/438; 279/75

(58) Field of Classification Search

CPC .. B25B 23/0007; B25B 23/0035; B25B 23/14

USPC ..... 81/429, 473–476, 438, 439, 451–453; 279/22, 29, 30, 75, 82, 143

See application file for complete search history.

(56) References Cited

U.S. PATENT DOCUMENTS

| | | | | |
|---|---|---|---|---|
| 5,437,524 | A | 8/1995 | Huang | |
| 5,950,509 | A | 9/1999 | Doong | |
| 5,996,452 | A | 12/1999 | Chiang | |
| 6,722,667 | B2 * | 4/2004 | Cantlon | 279/22 |
| 6,725,749 | B1 * | 4/2004 | Liou | 81/438 |
| 7,387,054 | B2 * | 6/2008 | Rajotte | 81/429 |
| 7,565,854 | B2 * | 7/2009 | Chiang et al. | 81/467 |
| 7,581,470 | B1 * | 9/2009 | Huang | 81/438 |
| 7,891,275 | B2 * | 2/2011 | Huang | 81/438 |
| 7,921,753 | B2 * | 4/2011 | Chen | 81/444 |
| 7,922,180 | B2 * | 4/2011 | Meng | 279/143 |

* cited by examiner

*Primary Examiner* — David B Thomas
(74) *Attorney, Agent, or Firm* — Charles E. Baxley

(57) ABSTRACT

A fastener holder includes a driving tool stem having a number of orifices, a driving tool shank engaged in the stem for engaging with a tool element and having a number of depressions formed in the shank, a number of bearing members engaged in the orifices of the stem for engaging with the depressions of the shank and for selectively anchoring the shank to the stem, and a barrel includes a relatively smaller segment for selectively engaging with the bearing members and for forcing the bearing members to engage into the depressions of the shank and to anchor and lock the driving shank to the stem and for allowing the driving shank and the tool element to be selectively rotated and driven by the stem.

14 Claims, 5 Drawing Sheets

FASTENER HOLDER FOR POWER TOOL

BACKGROUND OF THE INVENTION

1. Field of the Invention

The present invention relates to a fastener holder or holding device for power tool, and more particularly to a fastener holder or holding device including an outer protective sleeve or barrel provided or disposed or engaged onto and around the driving tool stem and/or the driving tool shank for suitably shielding and protecting the driving tool stem and/or the driving tool shank and for guiding the driving tool stem and/or the driving tool shank to suitably and effectively actuate or operate or drive the fasteners or the like.

2. Description of the Prior Art

Typical fastener couplers or holders or holding devices have been developed and provided for holding or carrying and coupling fasteners or the like to a power tool and for allowing the fasteners or the like to be suitably and effectively actuated or operated or driven by the power tool, and normally comprise a driving tool stem and/or a driving tool shank for engaging with a fastener and for connecting or coupling the fastener to the power tool, and thus for allowing the fastener to be rotated or driven by the power tool.

For example, U.S. Pat. No. 5,437,524 to Huang discloses one of the typical torque adjustment controllers or fastener couplers or holders or holding devices comprise a driving tool stem for engaging with a fastener and for connecting or coupling the fastener to the power tool, and an adjusting mechanism for adjusting the driven torque of the fastener by the power tool.

However, the driving tool stem and/or the fastener will be exposed and may not be suitably shielded and protected and also may not be suitably supported in place such that the fastener may not be suitably and effectively actuated or operated or rotated or driven by the power tool and may have a good chance to be disengaged from the driving tool stem and/or the power tool inadvertently.

U.S. Pat. No. 5,950,509 to Doong discloses another typical fastener coupler or holder or holding device for power tool and comprising a driving tool stem for engaging with a fastener and for connecting or coupling the fastener to the power tool, and an outer barrel provided or disposed or engaged onto and around the driving tool stem for guiding the driving tool stem to actuate or operate or drive the fastener.

The driving tool stem and/or the fastener will be driven and rotated in a great rotating speed relative to the outer barrel by the power tool, such that the smooth rotating engagement between the driving tool stem and the outer barrel will be important to shield and protect the driving tool stem and to guide the driving tool stem to drive the fastener. However, the connecting or coupling between the driving tool stem and the outer barrel is not good enough to facilitate the rotating of the driving tool stem relative to the outer barrel.

U.S. Pat. No. 5,996,452 to Chiang discloses a further typical chuck device or fastener coupler or holder or holding device for power tool and comprising a driving tool stem for engaging with a fastener and for connecting or coupling the fastener to the power tool, and an outer barrel provided or disposed or engaged onto and around the driving tool stem for guiding the driving tool stem to actuate or operate or drive the fastener.

However, the connecting or coupling between the driving tool stem and the outer barrel is not good enough to facilitate the rotating of the driving tool stem relative to the outer barrel.

The present invention has arisen to mitigate and/or obviate the afore-described disadvantages of the conventional fastener couplers or holders.

SUMMARY OF THE INVENTION

The primary objective of the present invention is to provide a fastener holder including an outer protective sleeve or barrel provided or disposed or engaged onto and around the driving tool stem and/or the driving tool shank for suitably shielding and protecting the driving tool stem and/or the driving tool shank and for guiding the driving tool stem and/or the driving tool shank to suitably and effectively actuate or operate or drive the fasteners or the like.

In accordance with one aspect of the invention, there is provided a fastener holder comprising a driving tool stem including a shaft extended therefrom for engaging into with a power tool and for being driven by the power tool, and including a bore formed therein, and including a number of orifices formed therein and communicating with the bore of the driving tool stem, and including an aperture formed therein and communicating with the bore of the driving tool stem, a driving tool shank rotatably engaged in the bore of the driving tool stem, and including an outer peripheral groove formed in the driving tool shank, and including a compartment formed in the driving tool shank and having a non-circular cross section for engaging with a tool element and for allowing the tool element to be rotated and driven by the driving tool shank, and including a number of depressions formed in the driving tool shank, an anchoring member slidably engaged in the aperture of the driving tool stem and extendible into the bore of the driving tool stem for engaging with the outer peripheral groove of the driving tool shank and for anchoring the driving tool shank to the driving tool stem and for guiding and limiting the driving tool shank to rotate relative to the driving tool stem, a number of bearing members slidably engaged in the orifices of the driving tool stem respectively and extendible into the bore of the driving tool stem for selectively engaging with the depressions of the driving tool shank and for selectively anchoring the driving tool shank to the driving tool stem and for allowing the driving shank and the tool element to be selectively rotated and driven by the driving tool stem, and a barrel including a first segment having a relatively greater chamber formed therein, and a second segment having a relatively smaller space formed therein and having an inner diameter smaller than that of the chamber of the barrel for slidably receiving and engaging with the driving tool stem and for forming an engaging surface between the chamber and the space of the barrel, the second segment of relatively smaller of the barrel selectively engageable with the bearing members to force the bearing members to engage into the depressions of the driving tool shank respectively and to anchor and lock the driving shank to the driving tool stem and for allowing the driving shank and thus the tool element to be selectively rotated and driven by the driving tool stem, and the bearing members being disengaged from the depressions of the driving tool shank to unlock and release the driving shank from the driving tool stem when the bearing members are moved out and disengaged from the relatively smaller space of the barrel and engaged in the relatively greater chamber of the barrel for allowing the driving shank to freely rotate relative to the driving tool stem and for preventing the driving shank from being rotated and driven by the driving tool stem.

The engaging surface formed between the chamber and the space of the barrel is a tilted and inclined engaging surface for selectively engaging with the bearing members and for guiding and forcing the bearing members to engage into the space of the barrel.

A spring biasing member may further be provided and engaged onto the driving tool stem and engaged with the barrel for biasing the second segment to engage with the bearing members and for forcing the bearing members to engage into the space of the barrel and to engage into the depressions of the driving tool shank respectively.

The barrel includes a peripheral flange extended radially and inwardly into the space which is formed in or at the second segment of the barrel for contacting and engaging with the spring biasing member.

The driving tool stem includes a stud having an outer diameter smaller than that of the driving tool stem for forming an outer peripheral shoulder between the driving tool stem and the stud and for selectively engaging with the peripheral flange of the barrel and for anchoring the driving tool stem to the barrel and for limiting the driving tool stem to slide and move relative to the barrel.

A housing may further be provided and includes a compartment formed therein for receiving and engaging with the spring biasing member and the second segment of the barrel, the spring biasing member is engaged between the barrel and the housing for biasing and forcing the second segment to engage with the bearing members.

The housing includes an inner peripheral rib extended radially and inwardly into the compartment thereof and contacted and engaged with the spring biasing member. The driving tool stem includes a retaining ring attached to the driving tool stem and engaged with the housing.

The driving tool shank includes a free end section having an outer diameter greater than that of the driving tool shank for forming an outer peripheral shoulder in the driving tool shank and for engaging with the driving tool stem and for anchoring the driving tool shank to the driving tool stem.

The driving tool shank includes an inner peripheral recess formed in one end portion of the driving tool shank and communicating with the compartment of the driving tool shank for engaging with a retaining ring which is provided for engaging with the tool element.

The barrel includes an end member engaged onto the first segment of the barrel, and the end member includes an inner peripheral stop extended radially and inwardly for engaging with the barrel and for anchoring the end member to the barrel. The barrel includes an outer peripheral channel formed therein for engaging with the inner peripheral stop of the end member.

The end member further includes an inner peripheral flange extended radially and inwardly therefrom for engaging with the first segment of the barrel and for positioning the end member to the barrel. A magnetic attractive ring member may further be provided and attached to the end member.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
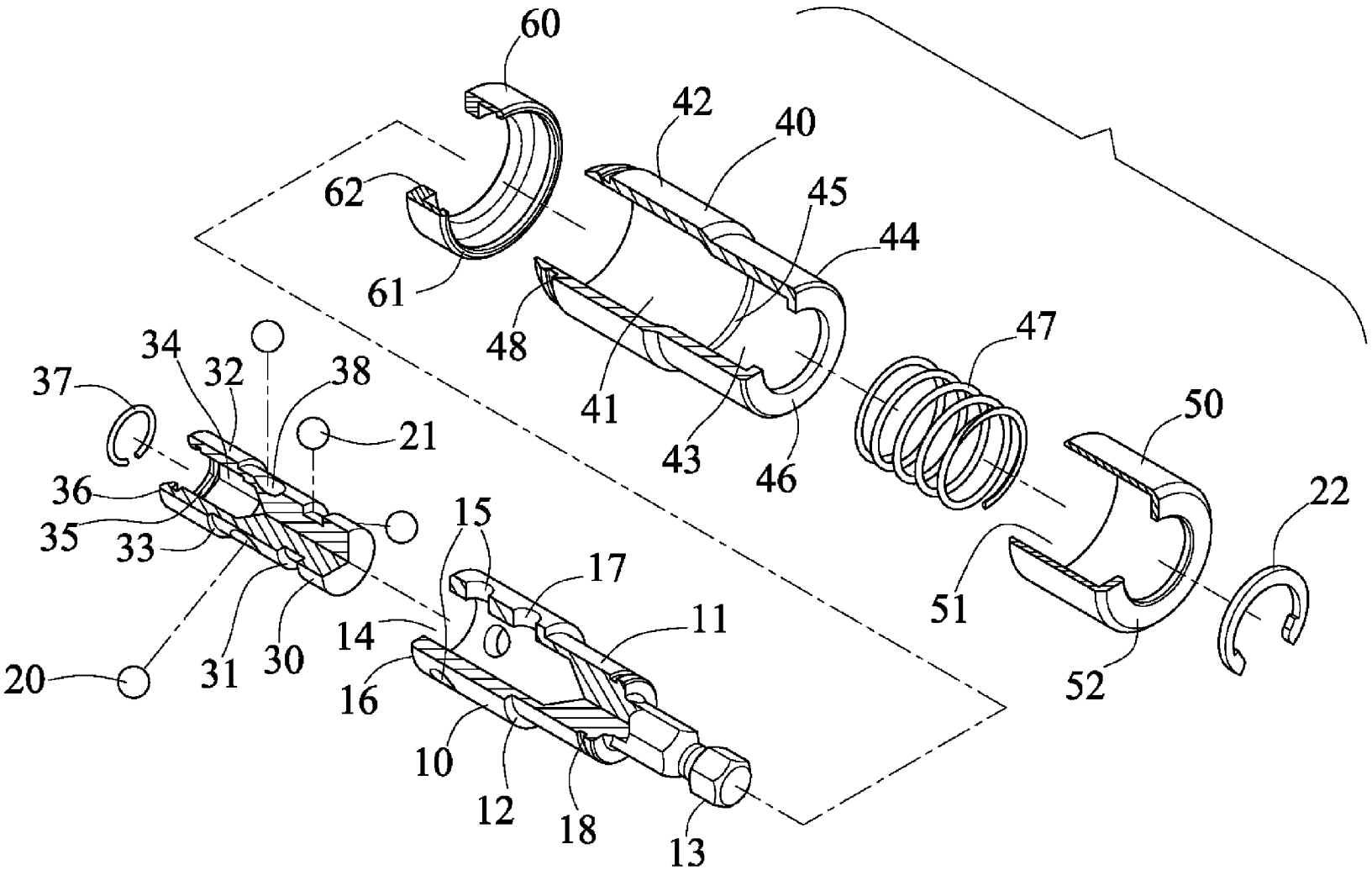
FIG. 1 is an exploded view of a fastener holder in accordance with the present invention.

Referring to the drawings, and initially to FIGS. 1-4, a fastener holder in accordance with the present invention comprises a driving tool body or spindle or driving tool stem 10 including a narrowed or diameter reduced stud 11 extended therefrom which includes an outer diameter smaller than that of the driving tool stem 10 for forming or defining an outer peripheral shoulder 12 between the driving tool stem 10 and the stud 11, and further including a shank or shaft 13 extended outwardly therefrom, such as extended outwardly from the stud 11 for engaging into or with the power tool 9 (FIG. 5) and for allowing the driving tool stem 10 to be selectively rotated or driven by the power tool 9. The connecting or coupling or engagement between the shaft 13 and the power tool 9 is typical and is not related to the present invention and will not be described in further details.

The driving tool stem 10 includes a chamber or cavity or hole or bore 14 formed therein, and/or partially formed in the stud 11, and includes a number of cavities or holes or orifices 15 formed therein, or includes one or more (such as three) orifices 15 formed therein (FIG. 4) and equally spaced from each other and located close to an outer or free end portion 16 thereof and communicating with the bore 14 of the driving tool stem 10 for slidably receiving or engaging with the balls or bearing members 20 which are extendible into the bore 14 of the driving tool stem 10, and includes a cavity or hole or aperture 17 formed therein and located beside one of the orifices 15 thereof and also communicating with the bore 14 of the driving tool stem 10 for slidably receiving or engaging with a detent or anchoring member 21 which are also extendible into the bore 14 of the driving tool stem 10, and further includes an outer peripheral slot 18 formed in the stud 11 for receiving or engaging with a clamping or retaining ring 22.

A follower or spindle or driving tool shank 30 is rotatably received or engaged in the bore 14 of the driving tool stem 10, and includes an outer peripheral groove 31 formed therein for receiving or engaging with the anchoring member 21 (FIGS. 3, 5) which may anchor or retain or position the driving tool shank 30 to the driving tool stem 10 for guiding and allowing the driving tool shank 30 to be pivoted or rotated relative to the driving tool stem 10 only and for preventing the driving tool shank 30 from being slid or moved longitudinally relative to the driving tool stem 10, and the sliding or bearing engagement of the anchoring member 21 in the outer peripheral groove 31 of the driving tool shank 30 may also be used to facilitate the rotationally movement of the driving tool shank 30 relative to the driving tool stem 10.

The driving tool shank 30 further includes an outer or free end segment or section 32 having an outer diameter greater than that of the driving tool shank 30 for forming or defining an outer peripheral shoulder 33 in the driving tool shank 30 and for engaging with the free end portion 16 of the driving tool stem 10, and for further anchoring or retaining or positioning the driving tool shank 30 to the driving tool stem 10 and for further preventing the driving tool shank 30 from being slid or moved longitudinally relative to the driving tool stem 10. The driving tool shank 30 further includes a hole or bore or chamber or cavity or compartment 34 formed therein and having a non-circular cross section for receiving or engaging with the corresponding non-circular tool bits or inserts or tool elements 23 and for allowing the tool elements 23 to be rotated or driven by the driving tool shank 30.

The driving tool shank 30 further includes an inner peripheral groove or slot or recess 35 formed therein, such as formed in the outer or free end portion 36 thereof and communicating with the compartment 34 thereof for receiving or engaging with another anchoring member or clamping or retaining ring 37 which is frictionally engageable with the tool element 23 for solidly and stably anchoring or retaining or positioning the tool element 23 to the driving tool shank 30 and for preventing the tool element 23 from being disengaged or separated from the driving tool shank 30, and the driving tool shank 30 further includes a number of or one or more (such as three) depressions 38 formed therein (FIGS. 1, 3-5) and equally spaced from each other for receiving or engaging with the balls or bearing members 20 and for selectively anchoring or retaining or securing the driving tool shank 30 to the driving tool stem 10 (FIGS. 3-4 and 6) and for allowing the driving shank 30 and thus the tool element 23 to be selectively rotated or driven by the driving tool stem 10.

Figure 3:
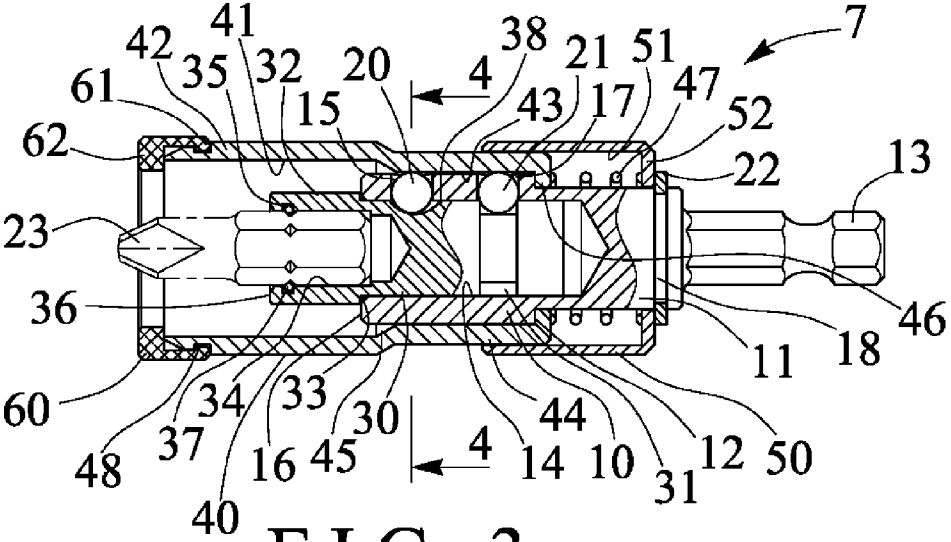
FIG. 3 is a cross sectional view of the fastener holder taken along lines 3-3 of FIG. 2.
Figure 4:
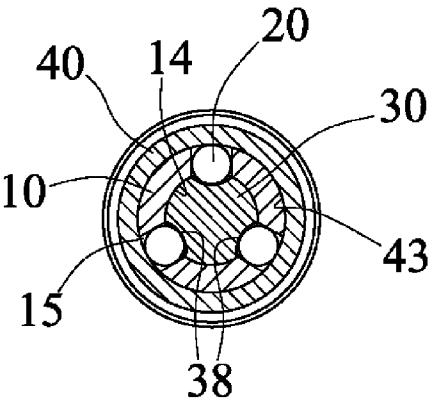
FIG. 4 is another cross sectional view of the fastener holder taken along lines 4-4 of FIG. 3.
Figure 2:
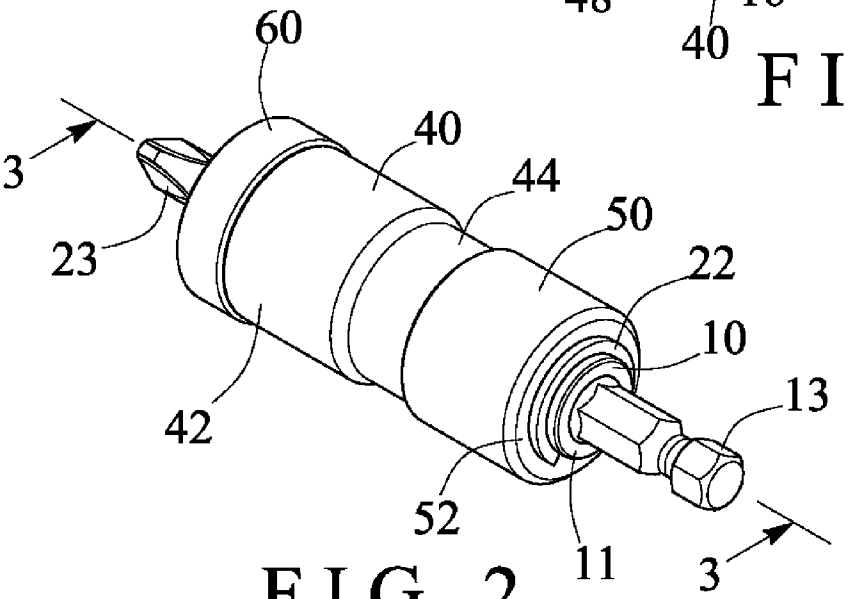
FIG. 2 is a perspective view of the fastener holder.
Figure 6:
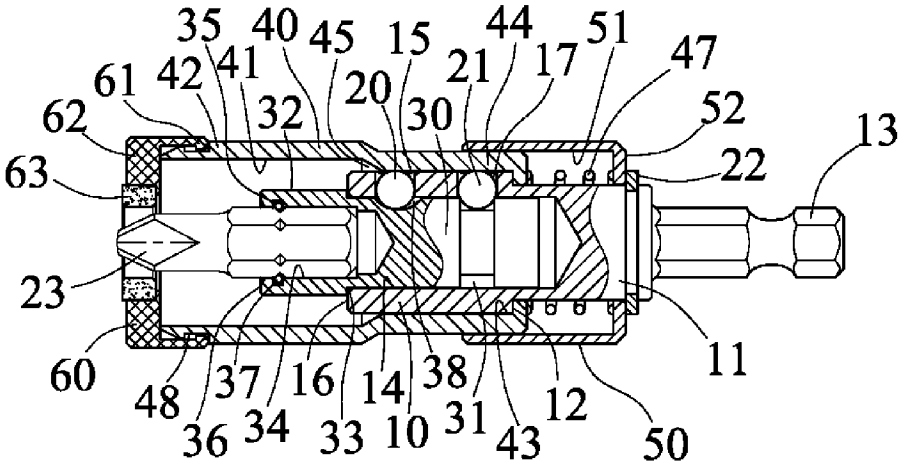
FIG. 6 is a still further cross sectional view similar to FIG. 3, illustrating the other application of the fastener holder.
Figure 5:
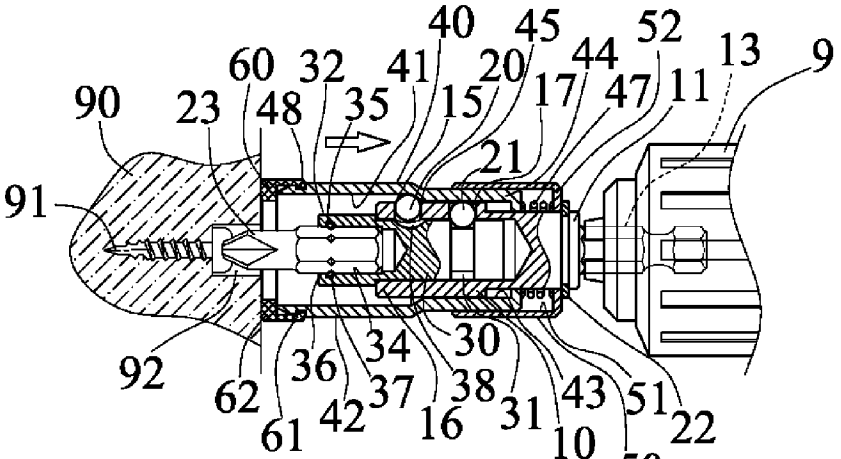
FIG. 5 is a further cross sectional view similar to FIG. 3, illustrating the operation of the fastener holder.
Figure 9:
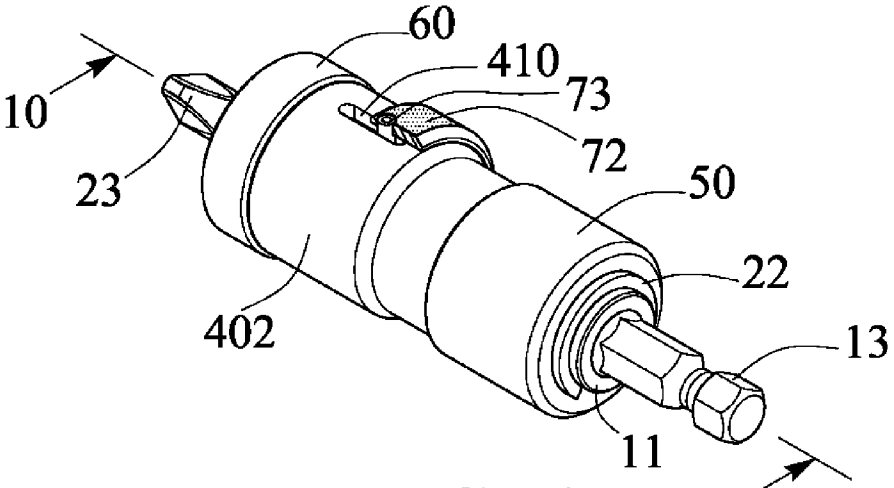
FIG. 9 is a further perspective view similar to FIGS. 2 and 7, illustrating the other arrangement of the fastener holder.
Figure 10:
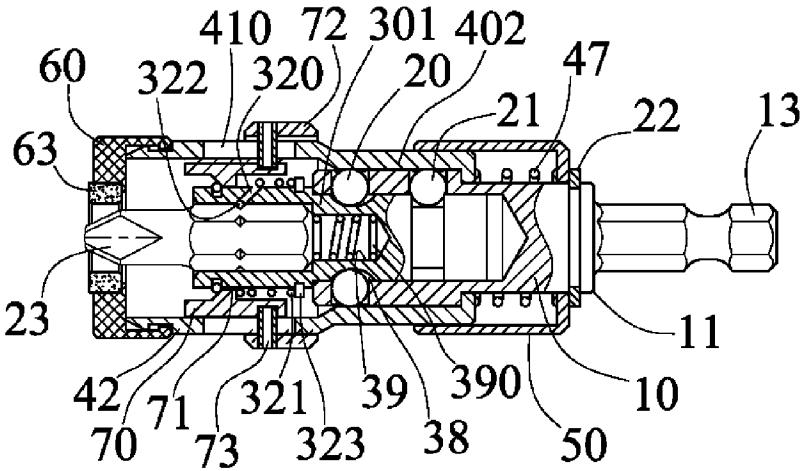
FIG. 10 is a cross sectional view of the fastener holder as shown in FIG. 9, taken along lines 10-10 of FIG. 9.

In operation, as shown in FIGS. 3-4 and 6, when the balls or bearing members 20 are received or engaged in the depressions 38 of the driving tool shank 30 respectively, the driving shank 30 may be anchored or retained or positioned or secured or coupled or locked to the driving tool stem 10 for allowing the driving shank 30 and thus the tool element 23 to be selectively rotated or driven by the driving tool stem 10 and/or the power tool 9. As shown in FIG. 5, when the bearing members 20 are disengaged from the depressions 38 of the driving tool shank 30, the driving shank 30 is no longer anchored or retained or positioned or secured or coupled or locked to the driving tool stem 10 such that the driving shank 30 is freely rotated relative to the driving tool stem 10 and such that the driving shank 30 may no longer be rotated or driven by the driving tool stem 10.

The fastener holder further includes an outer control ferrule or sleeve or cover or housing or barrel 40 having a relatively larger or greater bore or cavity or hole or compartment or chamber 41 formed therein, such as formed in the one or first half or end portion or segment 42 thereof, and a relatively smaller or reduced compartment or chamber or space 43 formed therein, such as formed in the other or second half or end portion or segment 44 thereof, in which the chamber 41 includes an inner diameter greater than that of the space 43 of the barrel 40 for forming or defining a tilted or inclined inner peripheral ramp or shoulder or engaging surface 45 between the chamber 41 and the space 43 of the barrel 40, in which the inner diameter of the space 43 of the barrel 40 is equal to or slightly greater than the outer diameter of the driving tool stem 10 for smoothly and snugly receiving or engaging with the driving tool stem 10.

As also shown in FIGS. 3-4 and 6, when the driving tool stem 10 and the bearing members 20 are received or engaged in the relatively smaller or reduced space 43 of the barrel 40, the other or second half or end portion or segment 44 of the barrel 40 may be caused or forced to selectively engage with the bearing members 20 and to force the bearing members 20 to engage into the depressions 38 of the driving tool shank 30 respectively, and to anchor or retain or position or secure or couple or lock the driving shank 30 to the driving tool stem 10 and thus for allowing the driving shank 30 and thus the tool element 23 to be selectively rotated or driven by the driving tool stem 10 and/or the power tool 9. The bearing members 20 may be used to facilitate the rotationally movement of the driving tool stem 10 relative to the barrel 40.

The tilted or inclined inner peripheral engaging surface 45 that is between the chamber 41 and the space 43 of the barrel 40 may guide and help and force the bearing members 20 to engage into the relatively smaller or reduced space 43 of the barrel 40 and to engage into the depressions 38 of the driving tool shank 30 respectively when the driving tool stem 10 and the bearing members 20 are moved and engaged into the space 43 of the barrel 40. As shown in FIG. 5, when the bearing members 20 are moved out and disengaged from the relatively smaller or reduced space 43 of the barrel 40 and received or engaged in the relatively larger or greater chamber 41 of the barrel 40, the bearing members 20 may be disengaged from the depressions 38 of the driving tool shank 30, and the driving shank 30 is not anchored or locked, or unlocked and released from the driving tool stem 10 such that the driving shank 30 is freely rotated relative to the driving tool stem 10 and such that the driving shank 30 may not be rotated or driven by the driving tool stem 10.

The barrel 40 further includes an inner peripheral rib or flange 46 extended radially and inwardly into the space 43 at the other or second half or end portion or segment 44 of the barrel 40 for selectively contacting or engaging with the outer peripheral shoulder 12 of the driving tool stem 10 and for anchoring or retaining the driving tool stem 10 to the barrel 40 or for limiting the driving tool stem 10 to slide or move relative to the barrel 40 and for preventing the driving tool stem 10 from being disengaged or separated from the barrel 40. A spring biasing member 47 is provided or disposed or engaged onto and around the stud 11 of the driving tool stem 10 and contacted or engaged with the barrel 40, such as the peripheral flange 46 of the barrel 40 for selectively moving or forcing the peripheral flange 46 of the barrel 40 to engage with the outer peripheral shoulder 12 of the driving tool stem 10 and for also selectively moving or forcing the bearing members 20 to engage into the relatively smaller or reduced space 43 of the barrel 40 and to engage into the depressions 38 of the driving tool shank 30 respectively.

An outer control ferrule or sleeve or barrel or cover or shield or housing 50 includes a hole or bore or chamber or cavity or compartment 51 formed therein for receiving or engaging with the spring biasing member 47 and the barrel 40, particularly the other or second half or end portion or segment 44 of the barrel 40 and for suitably shielding and protecting the spring biasing member 47, in which the spring biasing member 47 is disposed or engaged between the barrel 40 and the outer housing 50 for biasing and forcing the bearing members 20 to engage into the relatively smaller or reduced space 43 of the barrel 40 and to engage into the depressions 38 of the driving tool shank 30 respectively. The outer housing 50 includes an inner peripheral flange or rib 52 extended radially and inwardly into the compartment 51 thereof and contacted or engaged with the spring biasing member 47 and the stud 11 of the driving tool stem 10 and/or the retaining ring 22; or, the spring biasing member 47 may also be directly anchored or retained or secured or coupled to the stud 11 of the driving tool stem 10 without the retaining ring 22 and the outer housing 50.

In operation, as shown in FIG. 5, the barrel 40 may be provided for contacting or engaging with the work piece 90, and the tool element 23 may be provided for engaging with the fastener 91 which is to be forced to selectively engage into a hole or orifice or aperture or cavity 92 of the work piece 90, and before the fastener 91 is forced to engage into the cavity 92 of the work piece 90, the spring biasing member 47 may bias and force the barrel 40 to move onto the tool element 23 and to receive or engage the tool element 23 into the chamber 41 of the barrel 40, as shown in FIGS. 3 and 6, at this moment, the barrel 40 may be engaged with the bearing members 20 and may force the bearing members 20 to engage into the depressions 38 of the driving tool shank 30 respectively, and to anchor or retain or lock the driving shank 30 to the driving tool stem 10 and thus for allowing the driving shank 30 and the tool element 23 to be selectively rotated or driven by the driving tool stem 10 and/or the power tool 9.

Referring again to FIG. 5, when the fastener 91 is forced to engage into the cavity 92 of the work piece 90, the barrel 40 which is contacted or engaged with the work piece 90 will be stopped by the work piece 90 and may not be moved into the work piece 90, and the tool element 23 may be forced to engage into the cavity 92 of the work piece 90 and to move or to extend outwardly relative to the barrel 40, and simultaneously or relatively, the barrel 40 may be forced to move onto or against and to compress the spring biasing member 47 or to move toward the power tool 9 until the bearing members 20 are disengaged or separated from the space 43 of the barrel 40 and moved and engaged into the chamber 41 of the barrel 40. When the bearing members 20 are disengaged or separated from the space 43 of the barrel 40, the bearing members 20 will be disengaged from the depressions 38 of the driving tool shank 30 such that the driving shank 30 may not be rotated or driven by the driving tool stem 10 at this moment.

The barrel 40 may further include an outer peripheral channel 48 formed therein, such as formed in the one or first half or end portion or segment 42 of the barrel 40, and a ring or collar or cylindrical end member 60 is disposed or attached or engaged onto the one or first half or end portion or segment 42 of the barrel 40, and includes an inner peripheral rib or flange or stop 61 extended radially and inwardly therefrom for engaging with the outer peripheral channel 48 of the barrel 40 and for selectively anchoring or retaining or securing the end member 60 to the barrel 40 and for contacting or engaging with the work piece 90 (FIG. 5), the end member 60 may include another inner peripheral rib or stop or flange 62 extended radially and inwardly therefrom for engaging with the one or first half or end portion or segment 42 of the barrel 40 and for solidly and stably anchoring or retaining or positioning the end member 60 to the barrel 40. As shown in FIG. 6, a magnet or magnetic attractive ring member 63 may further be provided and attached or mounted or secured or engaged into the end member 60 for attracting the fastener 91 to the tool element 23.

Figure 7:
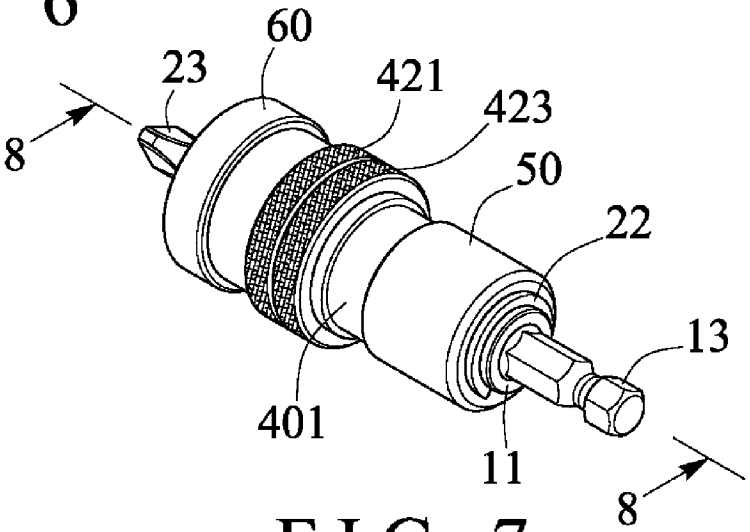
FIG. 7 is another perspective view similar to FIG. 2, illustrating the further application of the fastener holder.
Figure 8:
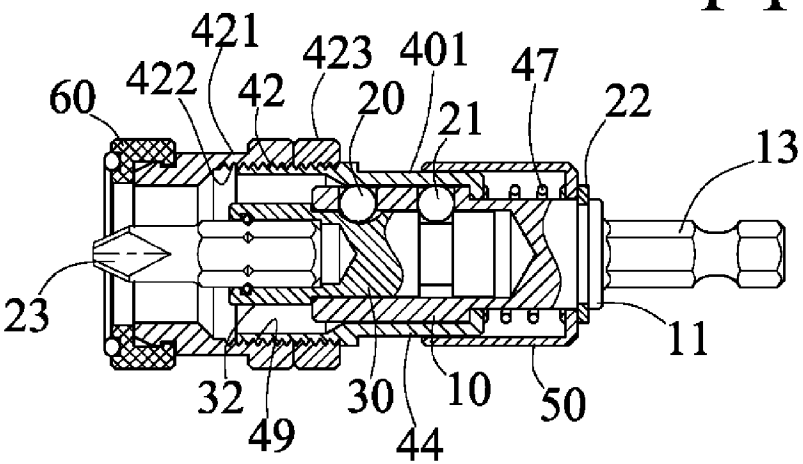
FIG. 8 is a cross sectional view of the fastener holder taken along lines 8-8 of FIG. 7.
Figure 12:
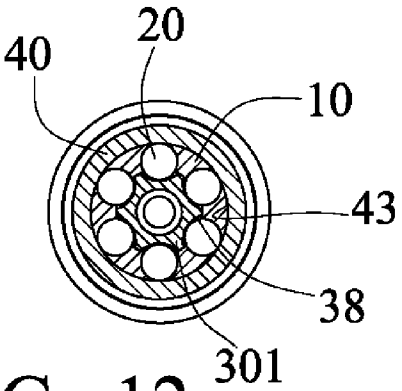
FIG. 12 is a further cross sectional view taken along lines 12-12 of FIG. 11.
Figure 11:
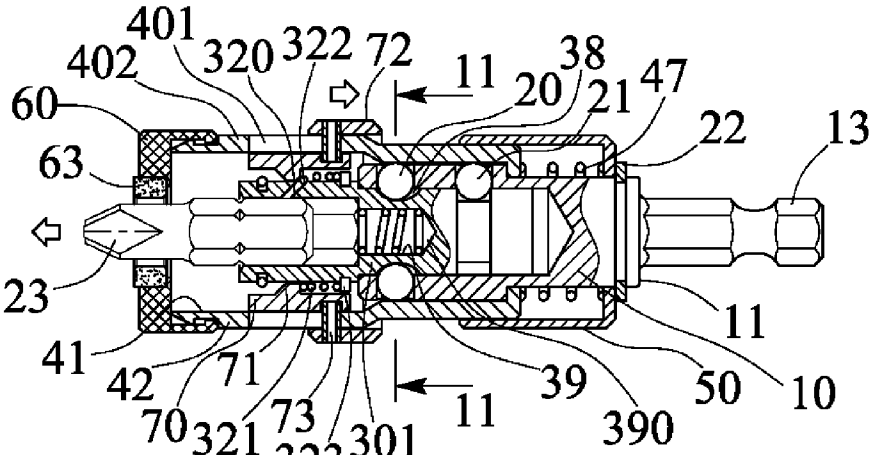
FIG. 11 is a further cross sectional view similar to FIG. 10, illustrating the operation of the fastener holder as shown in FIGS. 9-10.

Alternatively, as shown in FIGS. 7 and 8, the barrel 401 may include an outer thread 49 formed or provided on the one or first half or end portion or segment 42 of the barrel 401 and may further include an additional sleeve 421 having an inner thread 422 formed therein for threading or engaging with the outer thread 49 of the barrel 401 and for adjusting the sleeve 421 relative to the one or first half or end portion or segment 42 of the barrel 401 and for receiving or engaging with the tool element 23 of different lengths, and a lock nut 423 may further be provided and attached or mounted or secured or engaged onto the one or first half or end portion or segment 42 of the barrel 401 and also threaded or engaged with the outer thread 49 of the barrel 401 and contacted or engaged with the sleeve 421 for anchoring or retaining or positioning or securing the sleeve 421 to the barrel 401.

Further alternatively, as shown in FIGS. 9-12, the driving tool shank 301 may further include a cavity 39 formed therein for threading or engaging with a spring biasing member 390 which is engageable with the tool element 23 for selectively biasing and forcing the tool element 23 to move out of the driving tool shank 301, and may further include a tilted or inclined passage 320 formed therein, and another spring biasing member 321 may further be provided and attached or mounted or secured or engaged onto the driving tool shank 301 and includes an end portion 322 for selectively engaging into the tilted or inclined passage 320 of the driving tool shank 301 and for selectively engaging with the tool element 23 and thus for detachably anchoring or retaining or positioning or securing the tool element 23 to the driving tool shank 301. A clamping or retaining ring 323 is attached or mounted or secured or engaged onto the driving tool shank 301 and contacted or engaged with the spring biasing member 321 for anchoring or retaining or positioning or securing the spring biasing member 321 on the driving tool shank 301.

The driving tool shank 301 may include more (such as six) depressions 38 formed therein for receiving or engaging with more (such as six) bearing members 20. A pusher or operating or actuating member 70 may further be provided and attached or mounted or secured or engaged onto the driving tool shank 301 and slidably received or engaged in the chamber 41 of the barrel 402 and includes an operating or actuating tooth or pawl 71 for engaging with the spring biasing member 321 and for selectively moving or disengaging or separating the end portion 322 of the spring biasing member 321 from the tool element 23 and thus for allowing the tool element 23 to be selectively released or disengaged or separated from the driving tool shank 301 when required. The barrel 402 may include a slot or groove or pathway 402 formed therein, such as formed in the one or first half or end portion or segment 42 of the barrel 402.

Another control ferrule or sleeve or barrel or cover or shield or housing or knob 72 may further be provided and slidably attached or mounted or secured or engaged onto the one or first half or end portion or segment 42 of the barrel 402, and includes a pin 73 attached or mounted or secured or engaged or extended therefrom and slidably received or engaged in the pathway 402 of the barrel 402 and attached or mounted or secured or coupled to the actuating member 70 for moving the actuating member 70 relative to the driving tool shank 301 and the spring biasing member 321 and for selectively moving or disengaging or separating the end portion 322 of the spring biasing member 321 from the tool element 23, and thus for allowing the tool element 23 to be selectively released or disengaged or separated from the driving tool shank 301.

Figure 14:
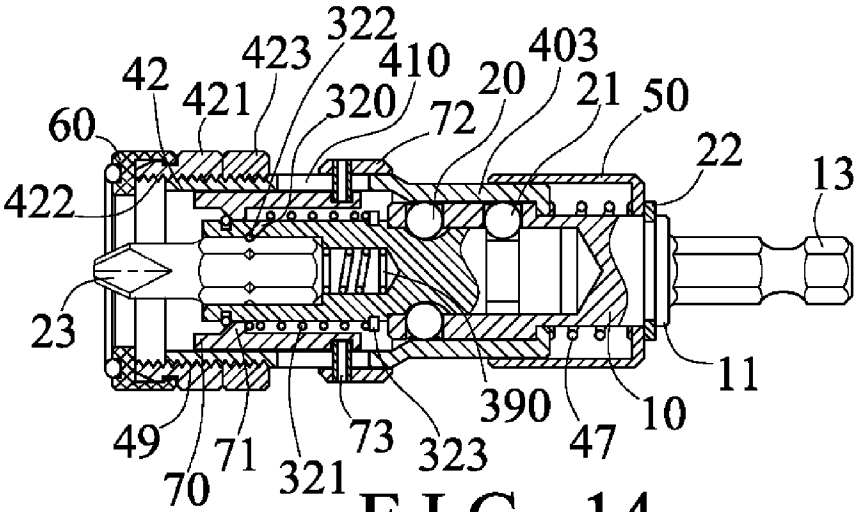
FIG. 14 is a further cross sectional view taken along lines 14-14 of FIG. 13.
Figure 13:
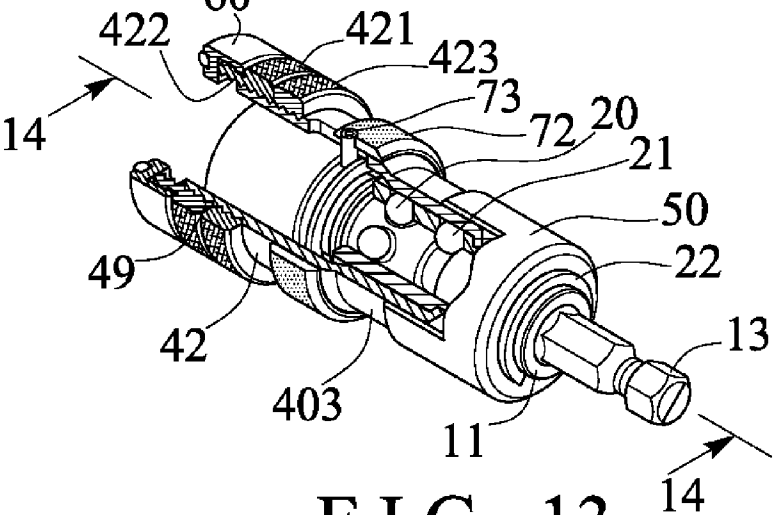
FIG. 13 is a still further partial perspective view similar to FIGS. 2, 7 and 9, illustrating the further arrangement of the fastener holder, in which a portion of the fastener holder has been cut off for showing the inner structure of the fastener holder.

Further alternatively, as shown in FIGS. 13-14, in addition to the actuating member 70 and the spring biasing member 321 and the actuating knob 72 as shown in FIGS. 9-12, the barrel 403 may further include an outer thread 49 formed or provided on the one or first half or end portion or segment 42 of the barrel 403 and may further include an additional sleeve 421 having an inner thread 422 formed therein for threading or engaging with the outer thread 49 of the barrel 403 and for adjusting the sleeve 421 relative to the one or first half or end portion or segment 42 of the barrel 403 and for receiving or engaging with the tool element 23 of different lengths, and a lock nut 423 may further be provided and attached or mounted or secured or engaged onto the one or first half or end portion or segment 42 of the barrel 403 and also threaded or engaged with the outer thread 49 of the barrel 403 and contacted or engaged with the sleeve 421 for anchoring or retaining or positioning or securing the sleeve 421 to the barrel 403.

Accordingly, the fastener holder in accordance with the present invention includes an outer protective barrel provided or disposed or engaged onto and around the driving tool stem and/or the driving shank for suitably shielding and protecting the driving tool stem and/or the driving shank and for guiding the driving tool stem and/or the driving shank to suitably and effectively actuate or operate or drive the fasteners or the like.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A fastener holder comprising:

a driving tool stem including a shaft extended therefrom for engaging into with a power tool and for being driven by the power tool, and including a bore formed therein, and including a plurality of orifices formed therein and communicating with said bore of said driving tool stem, and including an aperture formed therein and communicating with said bore of said driving tool stem, a driving tool shank rotatably engaged in said bore of said driving tool stem, and including an outer peripheral groove formed in said driving tool shank, and including a compartment formed in said driving tool shank and having a non-circular cross section for engaging with a tool element and for allowing said tool element to be rotated and driven by said driving tool shank, and including a plurality of depressions formed in said driving tool shank, an anchoring member slidably engaged in said aperture of said driving tool stem and extendible into said bore of said driving tool stem for engaging with said outer peripheral groove of said driving tool shank and for anchoring said driving tool shank to said driving tool stem and for guiding and limiting said driving tool shank to rotate relative to said driving tool stem, a plurality of bearing members slidably engaged in said orifices of said driving tool stem respectively and extendible into said bore of said driving tool stem for selectively engaging with said depressions of said driving tool shank and for selectively anchoring said driving tool shank to said driving tool stem and for allowing said driving shank and said tool element to be selectively rotated and driven by said driving tool stem, and a barrel including a first segment having a relatively greater chamber formed therein, and a second segment having a relatively smaller space formed therein and having an inner diameter smaller than that of said chamber of said barrel for slidably receiving and engaging with said driving tool stem and for forming an engaging surface between said chamber and said space of said barrel, said second segment of relatively smaller of said barrel being selectively engageable with said bearing members to force said bearing members to engage into said depressions of said driving tool shank respectively and to anchor and lock said driving shank to said driving tool stem and for allowing said driving shank and said tool element to be selectively rotated and driven by said driving tool stem, and said bearing members being disengaged from said depressions of said driving tool shank to unlock and release said driving shank from said driving tool stem when said bearing members are moved out and disengaged from said relatively smaller space of said barrel and engaged in said relatively greater chamber of said barrel for allowing said driving shank to freely rotate relative to said driving tool stem and for preventing said driving shank from being rotated and driven by said driving tool stem.

2. The fastener holder as claimed in claim 1, wherein said engaging surface formed between said chamber and said space of said barrel is a tilted and inclined engaging surface for selectively engaging with said bearing members and for guiding and forcing said bearing members to engage into said space of said barrel.

3. The fastener holder as claimed in claim 1 further comprising a spring biasing member engaged onto said driving tool stem and engaged with said barrel for biasing said second segment to engage with said bearing members and for forcing said bearing members to engage into said space of said barrel and to engage into said depressions of said driving tool shank respectively.

4. The fastener holder as claimed in claim 3, wherein said barrel includes a peripheral flange extended radially and inwardly into said space at said second segment of said barrel for engaging with said spring biasing member.

5. The fastener holder as claimed in claim 4, wherein said driving tool stem includes a stud having an outer diameter smaller than that of said driving tool stem for forming an outer peripheral shoulder between said driving tool stem and said stud and for selectively engaging with said peripheral flange of said barrel and for anchoring said driving tool stem to said barrel and for limiting said driving tool stem to slide and move relative to said barrel.

6. The fastener holder as claimed in claim 3 further comprising a housing including a compartment formed therein for receiving and engaging with said spring biasing member and said second segment of said barrel, said spring biasing member is engaged between said barrel and said housing for biasing and forcing said second segment to engage with said bearing members.

7. The fastener holder as claimed in claim 6, wherein said housing includes an inner peripheral rib extended radially and inwardly into said compartment thereof and contacted and engaged with said spring biasing member.

8. The fastener holder as claimed in claim 7, wherein said driving tool stem includes a retaining ring attached to said driving tool stem and engaged with said housing.

9. The fastener holder as claimed in claim 1, wherein said driving tool shank includes a free end section having an outer diameter greater than that of said driving tool shank for forming an outer peripheral shoulder in said driving tool shank and for engaging with said driving tool stem and for anchoring said driving tool shank to said driving tool stem.

10. The fastener holder as claimed in claim 1, wherein said driving tool shank includes an inner peripheral recess formed in said driving tool shank and communicating with said compartment of said driving tool shank for engaging with a retaining ring which is provided for engaging with said tool element.

11. The fastener holder as claimed in claim 1, wherein said barrel includes an end member engaged onto said first segment of said barrel, and said end member includes an inner peripheral stop extended radially and inwardly for engaging with said barrel and for anchoring said end member to said barrel.

12. The fastener holder as claimed in claim 11, wherein said barrel includes an outer peripheral channel formed therein for engaging with said inner peripheral stop of said end member.

13. The fastener holder as claimed in claim 11, wherein said end member includes an inner peripheral flange extended radially and inwardly therefrom for engaging with said first segment of said barrel and for positioning said end member to said barrel.

14. The fastener holder as claimed in claim 11, wherein a magnetic attractive ring member is attached to said end member.

* * * * *